US005609051A

United States Patent [19]

Donaldson

[11] Patent Number: 5,609,051

[45] Date of Patent: Mar. 11, 1997

[54] KEYLESS ENTRY SYSTEM FOR REPLACEMENT OF EXISTING KEY LOCKS

[76] Inventor: Edward M. Donaldson, 7234 E. Cave Creek Rd. #128, Carefree, Ariz. 85377

[21] Appl. No.: 515,993

[22] Filed: Aug. 16, 1995

[51] Int. Cl.[6] ..... E05B 49/00

[52] U.S. Cl. ..... 70/278; 70/279; 70/303 A; 70/333 A; 340/825.31

[58] Field of Search ..... 70/277–284, 332, 70/333 A, 333 R, 303, 208; 292/336.3, DIG. 31; 340/825.31

[56] References Cited

U.S. PATENT DOCUMENTS

| | | | |
|---|---|---|---|
| 3,656,327 | 4/1972 | Ford et al. | 70/133 |
| 4,019,355 | 4/1977 | Germanton | 70/278 |
| 4,148,092 | 4/1979 | Martin | 70/278 X |
| 4,197,726 | 4/1980 | Uyeda | 70/333 A X |
| 4,770,012 | 9/1988 | Johansson et al. | 70/278 |
| 4,776,190 | 10/1988 | Miller et al. | 70/333 A X |
| 4,802,353 | 2/1989 | Corder et al. | 70/278 X |
| 4,820,330 | 4/1989 | Lin | 70/278 X |
| 4,901,545 | 2/1990 | Bacon et al. | 70/278 |
| 4,956,984 | 9/1990 | Chi-Cheng | 70/279 X |
| 4,966,018 | 10/1990 | Hauber | 70/208 |
| 4,967,577 | 11/1990 | Gartner et al. | 70/279 |
| 5,040,391 | 8/1991 | Lin | 70/279 X |
| 5,061,923 | 10/1991 | Miller et al. | 70/278 X |
| 5,113,675 | 5/1992 | Uyeda | 70/279 X |
| 5,136,870 | 8/1992 | Gartner et al. | 70/278 X |
| 5,142,890 | 9/1992 | Uyeda et al. | 70/277 |
| 5,184,491 | 2/1993 | Schittenhelm | 70/278 |
| 5,219,386 | 6/1993 | Kletzmaier et al. | 70/277 |
| 5,475,996 | 12/1995 | Chen | 70/278 X |
| 5,487,290 | 1/1996 | Miller et al. | 70/303 A |
| 5,517,184 | 5/1996 | Dawson et al. | 340/825.31 |

*Primary Examiner*—Suzanne L. Dino
*Attorney, Agent, or Firm*—Frank J. McGue

[57] ABSTRACT

A keyless entry system is disclosed for use with a deadbolt latch mechanism on a door. The latch mechanism includes an arm having a slot for engaging and disengaging an associated deadbolt. The keyless entry system comprises an interior portion, an exterior portion and a drive arm connecting the portions. The interior portion has a housing mounted on the door. The housing has a base plate with a first opening aligned with the slot. A camlock with a ratchet is rotatably mounted on the base plate, the camlock having a second opening aligned with the first opening and the slot. A solenoid with a slug is also mounted on the base plate. The slug has a retracted position and an extended position with the slug engaging the ratchet in the extended position to prevent rotation of the camlock. An electronic controller is mounted on the base plate in electrical communication with the solenoid. The controller moves the solenoid slug from an extended position to a retracted position in response to entry of a coded sequence. The exterior portion comprises a linkage and a keypad in electrical communication with the electronic controller for manual entry of the coded sequence. A drive arm extends through the first and second openings and rotates in conjunction with the camlock and operably engages the slot of the latch mechanism. The drive arm is connected to the linkage and is rotatable thereby when the slug is retracted.

13 Claims, 6 Drawing Sheets

KEYLESS ENTRY SYSTEM FOR REPLACEMENT OF EXISTING KEY LOCKS

TECHNICAL FIELD

This invention relates to keyless entry systems, and, more particularly, to keyless entry systems used to replace existing keyed locks as used in residential entryways.

BACKGROUND OF THE INVENTION

Keyless entry systems provide an alternative means of locking doors for those families with children ("latch key kids") who might often lose keys, people who are uncomfortable with hiding spare keys, owners of rental properties confronted with lock replacement costs attendant with tenant turnover and simply individuals who do not appreciate fumbling for keys while holding an armload of groceries. However, conversion from a keyed lock to a keyless system has been an expensive proposition since the installation has required professional expertise. Thus, there is a need for a system which can convert an existing keyed lock at minimal cost and time yet still provide the aforementioned advantages of keyless entry.

DESCRIPTION OF THE PRIOR ART

U.S. Pat. No. 5,142,890 entitled "Electro-mechanical Lock with Rotary Bolt" issued on Sept. 1, 1992 to Uyeda et al. discloses an electronic lock for a safe.

U.S. Pat. No. 3,656,327 entitled "Electrically Operated Door Bolt" issued on Apr. 18, 1972 to Ford et al. discloses a solenoid controlled door bolt locking mechanism designed for use with a rotary permutation arrangement.

None of the known prior art disclose the system set forth herein.

SUMMARY OF THE INVENTION

It is an object of this invention to provide a system for conversion of an existing keyed lock into keyless entry.

It is a further object of the system to accommodate existing right and left handed opening doors with the same system.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
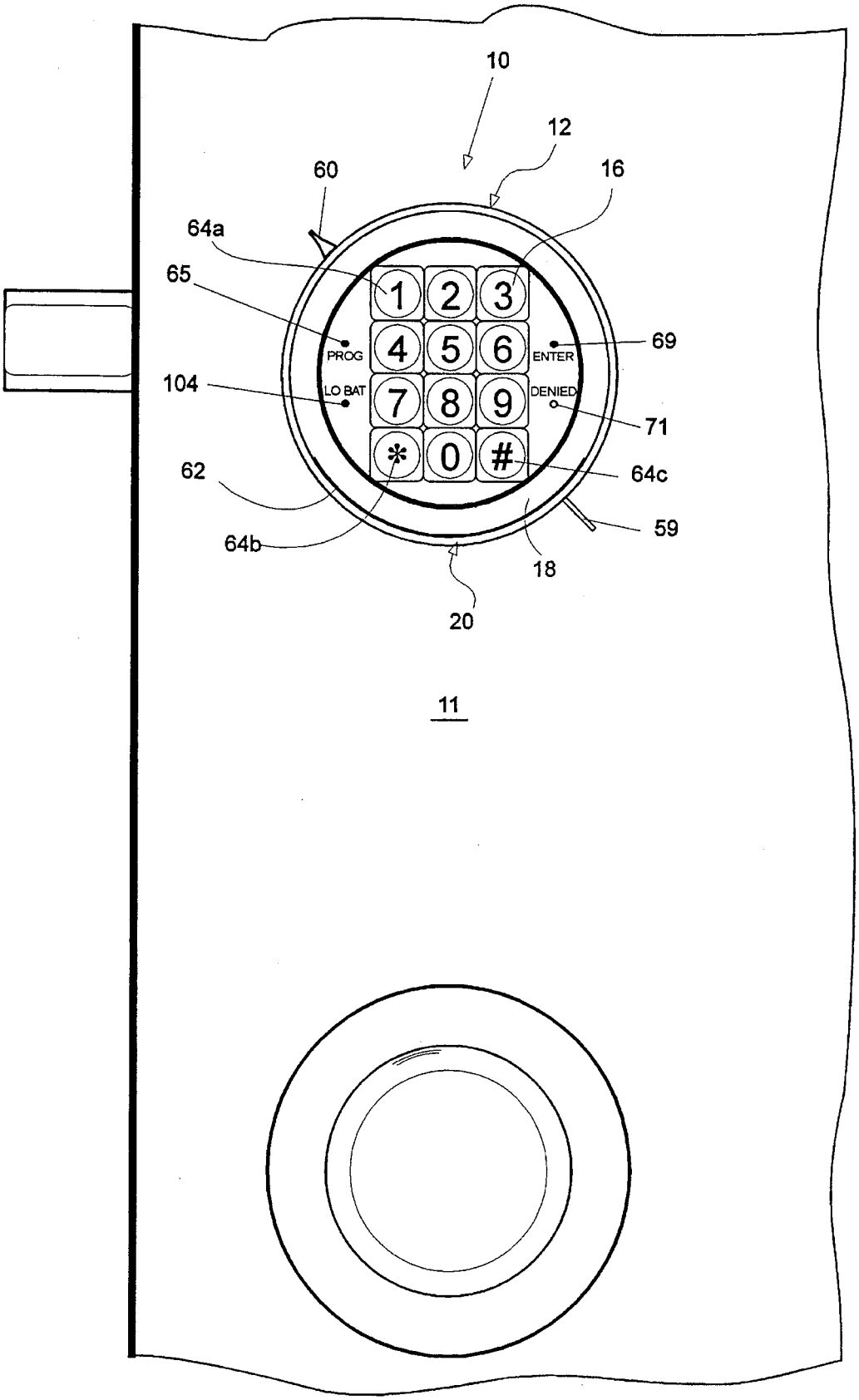
FIG. 1 is a front view of the exterior side of a door having the present invention installed thereon.
Figure 2:
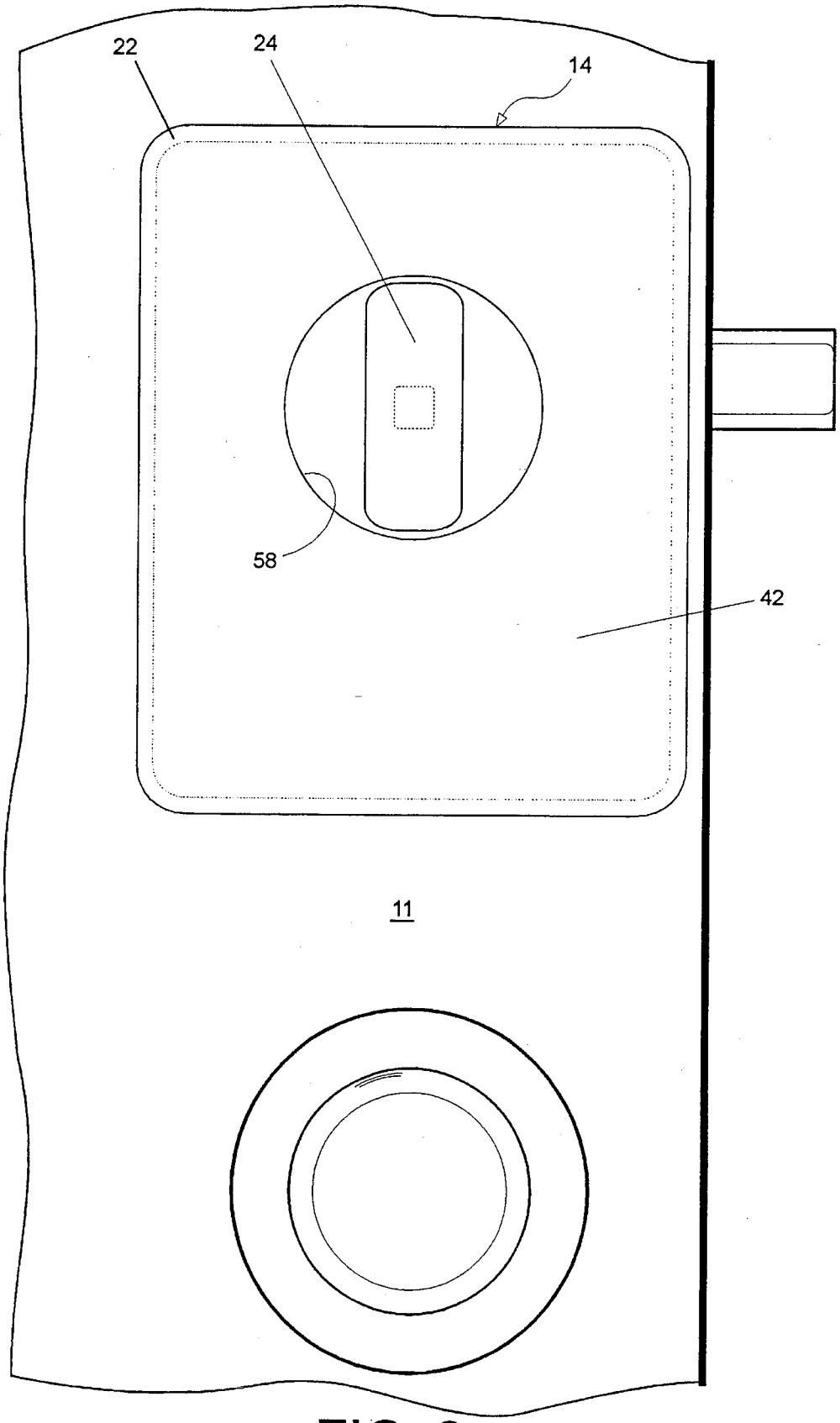
FIG. 2 is a rear view of the interior side of the door of FIG. 1.

Referring more particularly to the drawings by characters of reference, FIGS. 1–8 show a keypad entry system 10 for use on a door 11 for replacement of an existing lock comprising an exterior portion 12 seen in FIG. 1 and an interior portion 14 seen in FIG. 2. Exterior portion 12 includes a keypad 16, an exterior bezel 18 and a rotary ring 20. Interior portion 14 includes a housing 22, a handle 24, a camlock 28, a solenoid 30, a spring 32, and electronic control means 36 in electrical communication with a power source, preferably batteries 34. Connecting exterior portion 12 and interior portion 14 is a drive arm preferably comprising telescoping square tubing 26 and bolts 27.

Figure 3:
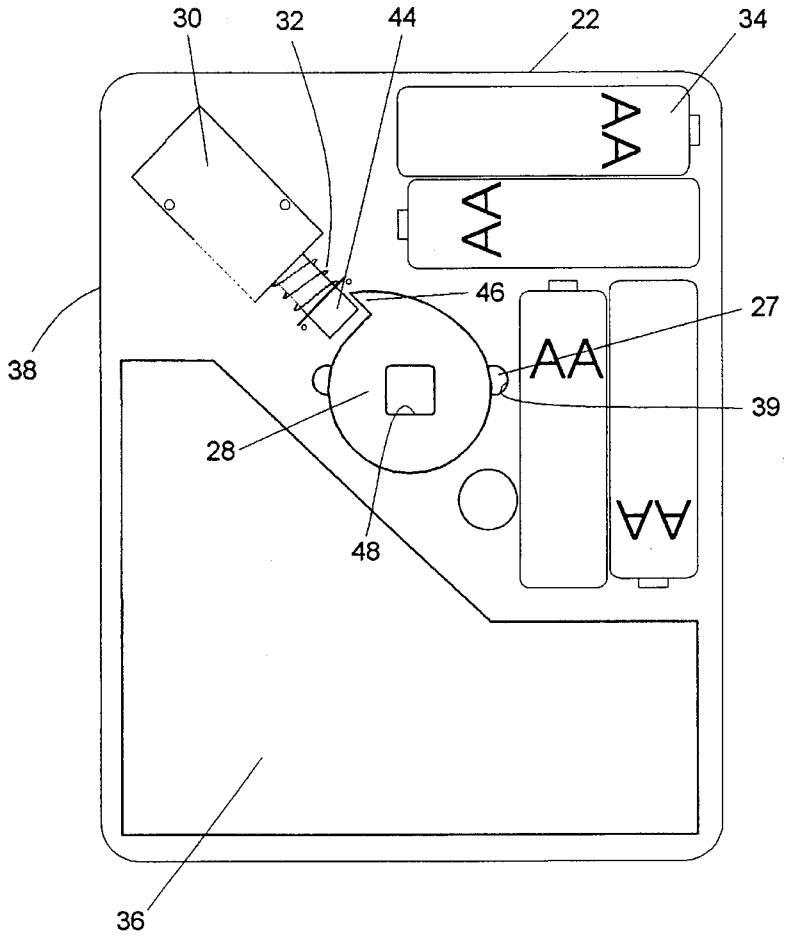
FIG. 3 is an rear view of the interior side of the present invention having the cover removed.
Figure 4:
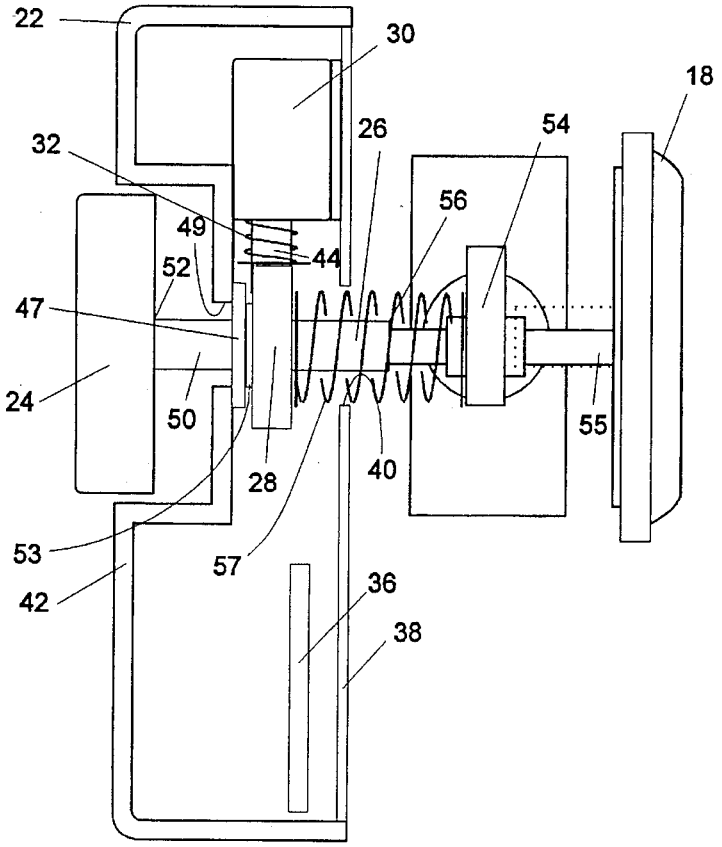
FIG. 4 is a cross sectional view of the present invention of FIG. 1.

As best seen in FIGS. 3 and 4, housing 22 includes a base plate 38 mounted to door 11 and a cover 42. Base plate 38 includes holes 39 through which bolts 27 extend. Base plate 38 also includes a first opening, preferably round hole 40. Mounted within housing 22 is electronic control means 36 powered by batteries 34 and in electrical communication with solenoid 30. The circuitry of the electronic control means 36 is discussed in detail below.

Solenoid 30 includes a slug 44 having an extended position and a retracted position as best seen in FIG. 3. Solenoid 30 is mounted in housing 22 whereby slug 44 extends radially towards camlock 28. In the extended position, slug 44 engages a ratchet 46 on camlock 28 thereby preventing rotation of camlock 28 in the counterclockwise direction as shown in FIG. 3.

It should be noted that if camlock 28 is rotated 180 degrees about its diameter, slug 44 and ratchet 46 would prevent rotation in the clockwise direction. Thus, the simple rotation of camlock 28 allows use of the present device on both left and right handed doors 11.

Camlock 28 includes a second opening, preferably a square center cutout 48 aligned with round hole 40 in base plate 38 through both of which extends a large square hollow tube 50. At the point on large square hollow tube 50 at which camlock 28 is mounted, a groove 51 is cut having a retaining ring 53 mounted therein for securing camlock 28 to tube 50.

Figure 5:
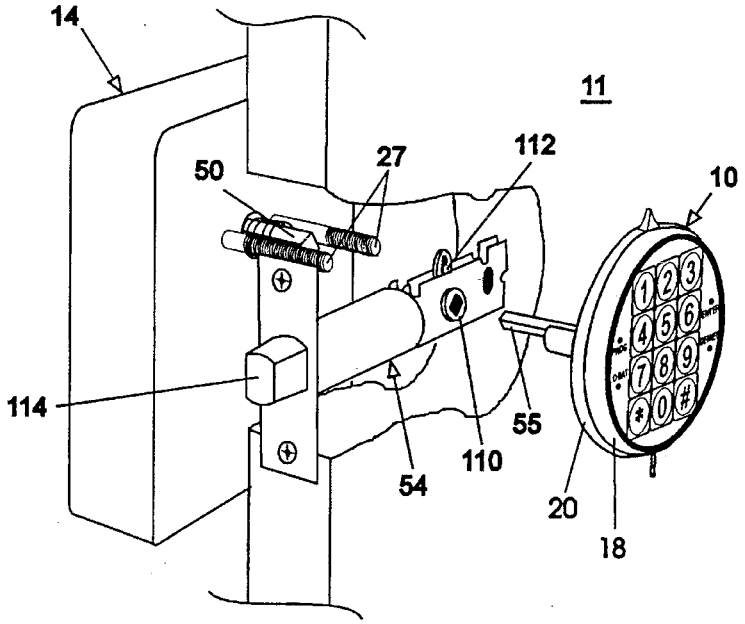
FIG. 5 is an exploded perspective view of present invention of FIG. 1.

As best seen in FIGS. 4 and 5, a first end 52 of large square hollow tube 50 extends through a third opening 49 on cover 42 of housing 22. Mounted thereon is handle 24 which fits into a corresponding indentation 58 on cover 42. At a second end 56 of large square hollow tubing 50 located opposite handle 24, small square tube 55 telescopes into large square hollow tube 50 thus, in combination, forming telescoping square tubing 26.

To open door 11 from its interior side, handle 24 is pushed into indentation 58, i.e. towards door 11, thereby telescoping large square hollow tube 50 over small square tubing 55. Camlock 28, secured by retaining ring 53 and groove 51 to large square hollow tube 50, also moves towards door 11 until ratchet 46 is no longer engaged by slug 44. At that point, handle 24 is rotated counterclockwise thereby disengaging a latch mechanism 54 which is engaged by small square tube 55.

A spring 57 is positioned between camlock 28 and latch mechanism 54 biasing camlock 28 and hence ratchet 46 to engagement with slug 44. When handle 24 is pushed towards door 11, spring 57 is compressed. When handle 24 is released after opening door 11, spring 57 pushes camlock 28 back towards slug 44. However, latch mechanism 54 will remain disengaged until handle 24 is rotated clockwise to allow re-engagement of ratchet 46 and slug 44. Thus, an individual can leave door 11 unlocked if desired.

Another function to telescoping square tubing 26 is to allow the present invention to be used on doors having varying thicknesses. In the present preferred embodiment, large hollow square tube 50 is 1.875 inches long, 5/16 inch across with a 1/16 inch wall and small square tube 55 is 2.5 inches, 3/16 inches across. Such a configuration allows use on doors 1.75 inches to 2.5 inches thick. Of course, other dimensions could be employed to meet any special needs.

As discussed previously, one end of small square tube 55 extends into large square hollow tube 50. From that point, small square tube 55 extends through latch mechanism 54. Small square tube 55 acts as the drive bar for latch mechanism 54. Latch mechanism 54 is preferably a standard deadbolt mechanism included in a keyed lock wherein small square tube 55 acts as the drive bar engaging a slotted arm 110. When small square tube 55 is turned counterclockwise, slotted arm 110 pushes a connector 112 and hence a bolt 114 into a corresponding slot on the door jamb. Reversing the turn in the clockwise direction disengages bolt 114 from the slot.

To replace a keyed deadbolt with the present invention, only the exterior keyhole assembly and the interior latch need to be replaced. The inner deadbolt latch mechanism 54 can remain in place.

In the illustrated embodiment, the latch mechanism 54 is that of a KWIKSET lock. However, those skilled in the art will recognize that other mechanisms are eminently suitable for use with the present invention. Also, latch mechanisms 54 are old in the art and will not be further discussed herein.

One end of a linkage 59 is mounted to a collar 61 which fits over the small square tube 55. The opposite end of linkage 59 engages rotary ring 20 via hole 67. Mounted opposite the point of engagement of linkage 59 and rotary ring 20, a finger grip 60 extends radially therefrom. When slug 44 is disengaged from ratchet 46, an individual may use grip 60 to rotate rotary ring 20 and, via linkage 59, collar 61 and small square tube 55 thereby retracting latch mechanism 54.

To prevent forcing of the door or related damage from an attempted forcing, linkage 59 is preferably a strip of material manufactured from a high memory spring steel which bends if forced without disengaging ratchet 46 from slug 44. Once the attempted forcing ceases, linkage 59 springs back to its normal position.

Figure 7:
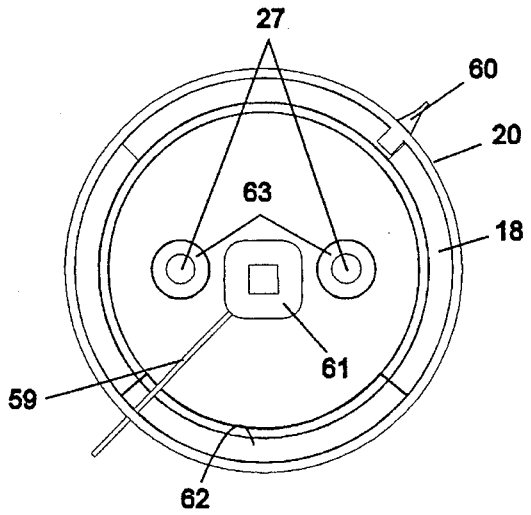
FIG. 7 is a back view of the exterior side of the present invention having a keypad removed.

As best seen in FIG. 7, rotary ring 20 is annular in shape and is rotatably mounted to and surrounding exterior bezel 18. As seen from the inside of door 11, bezel 18 is generally convex. A slot 62 subtending 90 degrees is cut on the bottom of bezel 18 to accommodate linkage 59 and its rotation. Mounting holes 63 corresponding to holes 39 in base plate 38 are used to secure exterior bezel 18 to plate 38.

Keypad 16 is mounted on the exterior bezel 18. Keypad 16 preferably includes a standard twelve keys arranged in a three by four matrix including numbered keys **64*a* (1-2-3-4-5-6-7-8-9-0) as well as an asterisk key 64*b*** (*) and a pound key **64*c*** (#) symbols. However, many such key arrangements are possible such as the five key combinations commonly used in automobiles.

Figure 6:
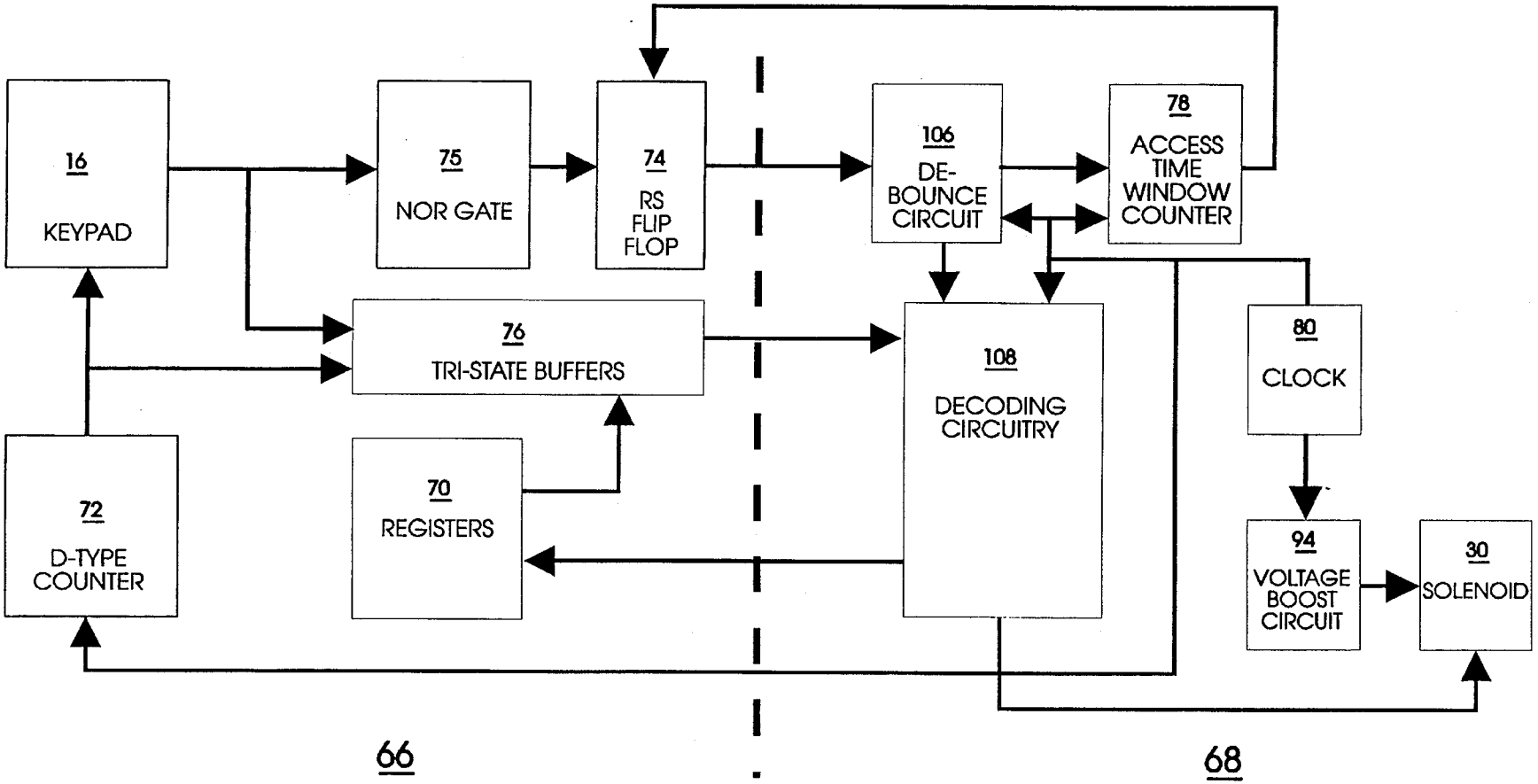
FIG. 6 is a functional block diagram of the control means for the present invention.
Figure 8:
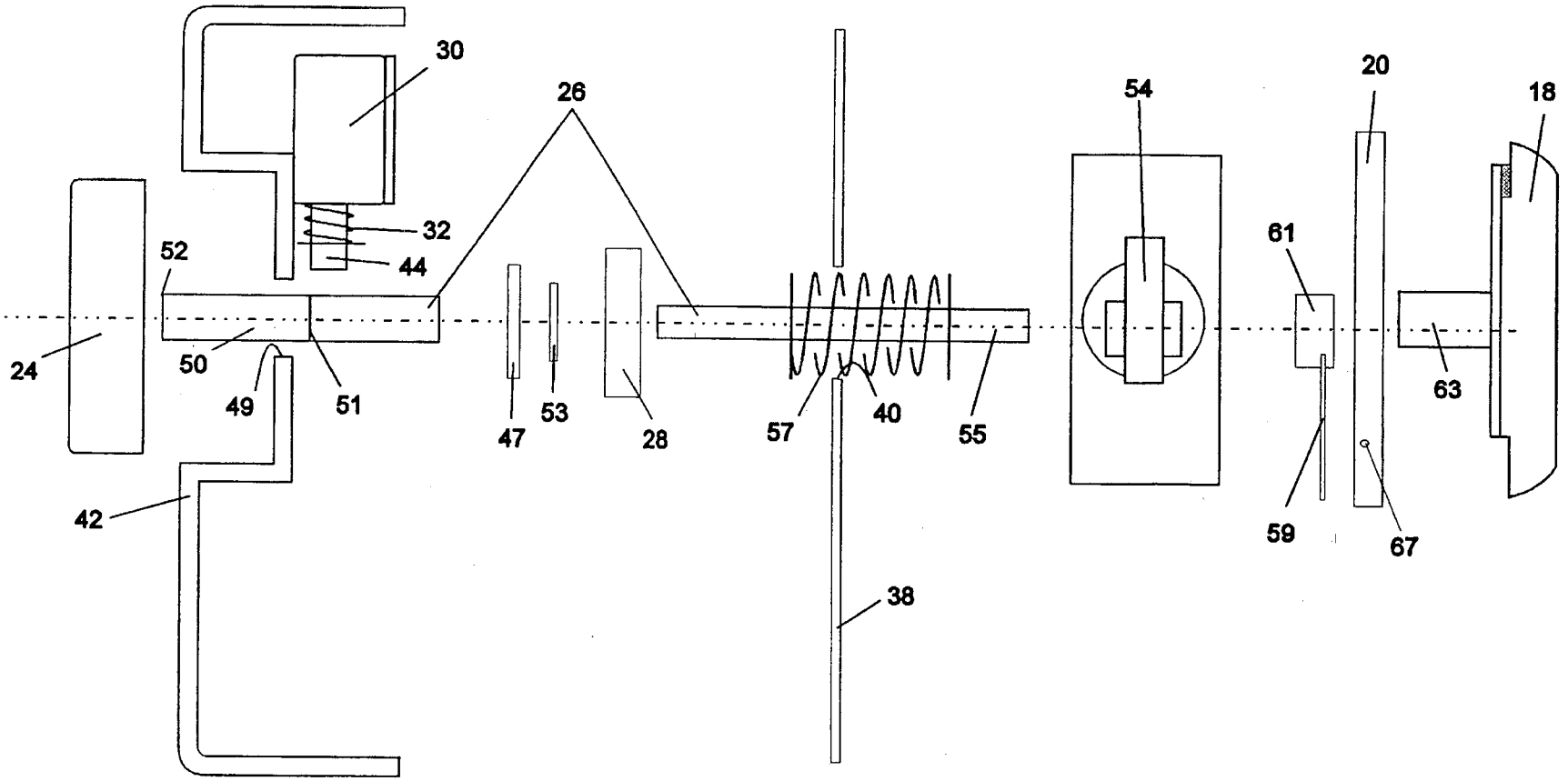
FIG. 8 is an exploded side view of the present invention.

Turning now to FIG. 6, the circuitry of electronic control means 36 of the preferred embodiment of the present invention is best seen in the form of a functional block diagram. It should be understood that the following description is of the presently preferred embodiment. The fundamental function of the circuitry described below is the use of a keypad of whatever configuration to enter a combination code and thereby activate a lock release mechanism instead of a key. Those skilled in the art will understand that many versions of such control circuits can be used to accomplish this purpose.

The circuit is divided into a continuously powered section 66 and a strobed power section 68. Continuously powered section 66 contains the programmed access combinations and the logic used to sense contact closure in the keypad. Thus, prior to detection of contact closure, electronic control means 36 is in a standby or low power consumption mode.

Strobed power section 68 contains the bulk of the circuitry for decoding the keypad 16, a 20 Khz oscillator or clock 80, the voltage boost circuit 94, solenoid driver, the status LED drivers, the low battery sense monitor, the access combination comparison logic, the programming hierarchy function logic and the time-out logic for de-bouncing the switch contacts and the access code entry time window. Use of continuously powered section 66 with strobed power section 68 can extend battery life to over two years.

More specifically, continuously powered section 66 includes sixteen four-bit registers 70, a four-bit D-type counter 72, an RS flip-flop 74 and tri-state buffers 76. The sixteen four-bit registers 70 store the four sets of programmed combinations used for comparison to the combinations entered via keypad 16. Since registers 70 interface with logic circuitry found in strobed power section 68, the outputs are tri-stated (switched to a high impedance state) during standby.

The four-bit D-type counter 72 is used as a ring or "Johnson" counter to drive the "3" side of the 3×4 switch matrix of keypad 16. Counter 72 does a cyclic count of 3 during normal operation. During standby, counter 72 is held in a reset condition whereby all the outputs will be at a logic "1" level.

RS flip-flop 74 is set by the output of a 4 input NOR gate 75 whose inputs are the "4" side of the 3×4 switch matrix of keypad 16. The inputs are reset by the output of an access time window counter 78 discussed more fully below. When set, RS flip-flop 74 initiates power to the strobed power section 68, putting that circuitry into the normal mode, and initializing decoding circuitry 108 to the proper states while starting 20 KHz clock 80 and the boost voltage for the solenoid actuation.

Tri-state buffers 76 interface the switch matrix with the decoding circuitry 108 and are tri-stated during standby. More specifically, keypad 16 decoding circuitry 108 in strobed power section 68 decodes each numeric key **64*a* to an inverse hexadecimal number. In this manner, the master level or highest hierarchical level of programmed memory output states is all ones or all zeros. The programming mode can be initiated by pressing pound sign (#) key 64*c* which also activates the PROG LED 65. A legitimate access sequence of four numbers can then be entered. This scenario is used when changing batteries 34 thereby interrupting power and thereby resetting the volatile memory. Asterisk key 64*b*** (*) and pound sign (#) keys **64*c*** are not decoded as hexadecimal numbers but are used to implement functions.

The access combination comparison circuit does an EXCLUSIVEOR function of each hexadecimal bite of the data bus and the program bus (each four bits wide) and logs the result for each hierarchical level. Four successive positive comparisons (one for each digit of the combination) actuate the solenoid 30 thereby releasing camlock 28 such that the latch mechanism 54 can be retracted for entry. In addition, ENTER LED 69 is lit. If the comparisons are not successful, the DENIED LED 71 will be lit.

The access combination can be reprogrammed at that time by depressing asterisk key 64*b* and numeric key 64*c* corresponding to the hierarchical level desired, zero (0) being the highest level. The level being programmed, however, cannot be higher hierarchically than the successful access combination level entered.

20 KHz clock 80 is an analog comparator application (astable multivibrator). The threshold voltage levels are set by resistor combinations to be ⅓ and ⅔ of source voltage (Vcc). When power is turned on, the threshold voltage at the comparator's (+) or non-inverting input is ⅔ Vcc. The comparator output voltage (at Vcc) charges a timing capacitor connected to its (–) inverting input through a timing resistor until the charge level of the timing capacitor exceeds ⅔ Vcc. The comparator is switched to a potential close to zero (0) volts discharging the timing capacitor in a like manner until the voltage on the timing capacitor is less than ⅓ Vcc. At that time, the comparator switches back to Vcc thereby repeating the process. The net result is a 50% duty cycle square wave output whose frequency is essentially source voltage independent. The voltage waveform at the timing capacitor is a sawtooth varying from ⅓ Vcc to ⅔ Vcc with exponential rise and fall times.

The voltage boost circuit 94 is an analog comparator application also. The comparator's (–) or inverting input is connected to the sawtooth waveform created by the 20 Khz clock 80 circuit. The (+) or non-inverting input is connected to a resistor combination designed to charge a storage capacitor. When the correct access combination is detected by decoding circuitry 108, voltage boost circuit 94 will actuate solenoid 30.

The low battery voltage monitor compares the battery voltage through a resistor divider network to that of a reference diode such that when the derived battery voltage drops below that of the reference level, the comparator output is switched to a low voltage level, conducting current through a light emitting "LO BATT" diode 104 (LED) which indicates this status.

The time out logic for the de-bounce time delay is achieved by dividing 20 kHz clock 80 frequency by a debounce circuit 106 to accomplish a delay of 25.6 milliseconds before clocking the data into the recognition and comparison circuitry. The contacts of keypad 16 preferably have no more than 10 milliseconds of "contact chatter".

The access code entry time window logic consists of ripple down counters 108 dividing clock 80 frequency to provide a 5.5 second time window for the combination to be keyed in. In the event that programming is desired after successful entry of the combination, the time window is extended 5.5 seconds for this function. When the 5.5 seconds have elapsed, the circuitry is returned to the standby mode.

Although only certain embodiments have been illustrated and described, it will be apparent to those skilled in the art that various changes and modifications may be made therein without departing from the spirit of the invention or from the scope of the appended claims.

What is claimed is:

1. A keyless entry system for use with a deadbolt latch mechanism mounted on a door, the door having an exterior and an interior, the latch mechanism having an arm having a slot for engaging and disengaging an associated deadbolt, the keyless entry system comprising:

an interior portion comprising:

a housing mounted on the interior of the door, the housing having a base plate, the base plate having a first opening aligned with the slot;

a camlock having a ratchet rotatably mounted on the base plate, the camlock having a second opening aligned with the first opening and the slot;

a solenoid having a slug mounted on the base plate, the slug having a retracted position and an extended position, the slug engaging the ratchet in the extended position to prevent rotation of the camlock;

electronic control means mounted on the base plate, the electronic control means being in electrical communication with the solenoid, the electronic control means moving the solenoid slug from an extended position to a retracted position and vice versa in response to entry of a coded sequence;

and exterior portion comprising:

a keypad in electrical communication with the electronic control means for manual entry of the coded sequence, the keypad being mounted on the exterior of the door; and a drive arm extending through the first and second openings, the drive arm rotating with the camlock, the drive arm extending through the slot of the latch mechanism, the drive arm being connected to a linkage, the linkage comprising a strip of high memory spring steel having one end mounted to the drive arm while the other end engages a rotary ring mounted on the exterior of the door, the drive arm being rotable by the linkage when the slug is in the retracted position.

2. The keyless entry system of claim 1 wherein said second opening and said slot are square cutouts and further wherein said drive arm comprises corresponding square tubing.

3. The keyless entry system of claim 2 wherein the square tubing further comprises at least two square telescoping tubes.

4. The keyless entry system of claim 1 further comprising a cover mounted over said base plate.

5. The keyless entry system of claim 4 wherein the drive arm further comprises two telescoping tubes spring biased to engage the ratchet and the slug, the system further comprising:

an indentation on the cover, the indentation having a third opening aligned with the first opening, the drive arm extending through said third opening, a handle mounted on the drive arm extending into said indentation whereby pushing said handle laterally manually disengages said ratchet from said slug and rotation of said handle disengages the deadbolt latch mechanism.

6. The keyless entry system of claim 1 wherein the rotary ring includes a finger grip.

7. The keyless entry system of claim 6 further comprising an exterior bezel, said bezel being convex as viewed from the inside of said door, the rotary ring being annular in shape and surrounding the bezel, the bezel including a slot to accommodate the strip.

8. The keyless entry system of claim 1 further comprising mounting holes in the bezel and corresponding holes in the base plate for extending steel bolts to the bezel from the base plate.

9. The keyless entry system of claim 1 wherein the keypad comprises a three by four alphanumeric matrix.

10. The keyless entry system of claim 1 wherein the electronic control means further includes at least one battery as a power source.

11. The keyless entry system of claim 1 wherein the electronic control means further comprises a continuously powered section and a strobed power section.

12. The keyless entry system of claim 11 wherein the continuously powered section comprises at least one programmed access combination and a logic circuit to sense contact closure in the keypad.

13. The keyless entry system of claim 11 wherein the strobed power section comprises a circuit for decoding the keypad, a 20 Khz clock, a voltage boost circuit, a solenoid driver, at least one status LED driver, a low battery sense monitor, an access combination comparison logic circuit, a programming hierarchy function logic circuit and a time-out logic circuit for de-bouncing the keypad and an access code entry time window.

* * * * *